United States Patent [19]

Honma

[11] Patent Number: 4,747,887

[45] Date of Patent: May 31, 1988

[54] METHOD AND DEVICE FOR ACTUATING SHAPE MEMORY ALLOY MEMBER

[75] Inventor: Dai Honma, Tanashi, Japan

[73] Assignee: Naomitsu Tokieda, Tokyo, Japan

[21] Appl. No.: 38,462

[22] Filed: Apr. 13, 1987

Related U.S. Application Data

[63] Continuation of Ser. No. 763,402, Aug. 7, 1985, abandoned.

[30] Foreign Application Priority Data

Dec. 6, 1984 [JP] Japan ..... 59-256547

[51] Int. Cl.[4] ..... C22C 19/00; C22F 1/00

[52] U.S. Cl. ..... 148/131; 148/402

[58] Field of Search ..... 148/402, 131, 11.5 N, 148/13, 13.1

[56] References Cited

U.S. PATENT DOCUMENTS 3,883,885 5/1975 Orlando ..... 148/402

3,948,688 4/1976 Clark ..... 148/402

*Primary Examiner*—L. Dewayne Rutledge

*Assistant Examiner*—S. Kastler

*Attorney, Agent, or Firm*—Birch, Stewart, Kolasch & Birch

[57] ABSTRACT

A method for actuating a member made of shape memory alloy, including stressing the shape memory alloy member so that its Ms point becomes positioned between its As point and its Af point, and applying a pulsed supply of electricity to it to heat it up is disclosed. The voltage and the duty factor d of the pulsed supply of electricity ensure that the relations $\theta$ha greater than $-\theta$ca and "d" less than or equal to $\theta_{cc}/(\theta cc - \theta hb)$ are satisfied, where $\theta_{ha}$ is the heating speed of the shape memory alloy member in the region below its As point, $\theta$hb is the heating speed of the shape memory alloy member in the region between its As point and its Af point, $\theta_{cc}$ is the cooling speed of the shape memory alloy member in the region above its Ms point, and $\theta$ca is the cooling speed of the shape memory alloy member in the region below its Mf point. Thereby, the shape memory alloy member is heated in an even, smooth, and controlled fashion for its actuation, so that there is substantially no risk of overheating of any of its parts during actuation, because large temperature differentials are not produced in the member. Thus, the service life of the member is kept long, because substantially no damage is engendered to its alloy material, since its temperature is kept stabilized near the transformation point. A device for practicing thus method is also described.

4 Claims, 3 Drawing Sheets

METHOD AND DEVICE FOR ACTUATING SHAPE MEMORY ALLOY MEMBER

This application is a continuation of application Ser. No. 763,402 filed on Aug. 7, 1985, now abandoned.

BACKGROUND OF THE INVENTION

The present invention relates to a method and a device for actuating a member made of a shape memory alloy material, and in particular, the present invention relates to such an actuating method and device which utilize the Joule effect produced by passing an electric current through a shape memory alloy member for heating the member, the member being in the prestressed state and the parameters of the wave form of the electric current being particularly tailored so as to best actuate and utilize the shape recovering property of the shape memory alloy of which the member is made, in order to perform thermal/mechanical energy conversion.

There are various known forms of thermal/mechanical energy conversion devices utilizing the shape recovering property of shape memory alloy in order to perform thermal/mechanical energy conversion. Typically, these energy conversion devices are utilized in robot manipulators and the like. When a member made of shape memory alloy is supplied with an input of thermal energy and heated, as for example by the Joule effect which is produced by an electric current passed through the member, the member exerts a force in the direction which will bring its shape closer to the original shape via a phase transformation (the reversion transformation from the martensite phase to the parent phase), and its shape that tends to alter towards an original shape it remembers. This force tending towards the alteration of the shape of the member is utilized for driving a driven member in a particular desired direction, thus performing mechanical work.

This use of the Joule effect for heating a member made of shape memory alloy to actuate it is per se known. However, various problems tend to arise with this heating method. Particularly, the various parts of the member are not heated evenly, and large temperature differentials are produced in the member. This means that certain portions (at least) of the member are heated up far beyond the temperature region in wihch phase transformation takes place, thus causing heat damage to the alloy in these portions, and shortening of the operational life of the member.

SUMMARY OF THE INVENTION

Accordingly, it is a primary object of the present invention to provide a method for actuating a member made of shape memory alloy, and a device for practicing the method, which avoid the above outlined problems.

It is a further object of the present invention to provide such a method and device, which heat the member evenly for its actuation.

It is a further object of the present invention to provide such a method and device, which do not overheat any parts of the member during actuation.

It is a further object of the present invention to provide such a method and device, which do not produce large temperature differentials in the member while actuating it.

It is a further object of the present invention to provide such a method and such a device, which keep the service life of said member long.

It is a yet further object of the present invention to provide such a method and device, which do not engender any damage to the alloy material of the member.

It is a yet further object of the present invention to provide such a method and the device, which keep the temperature of said member stabilized near the transformation point.

According to the most general aspect of the present invention, these and other objects are accomplished by a method for actuating a member made of shape memory alloy, wherein: (a) the shape memory alloy member is stressed so that its Ms point becomes positioned between its As point and its Af point; and (b) a successively pulsed supply of electricity with a substantially rectangular wave form is aplied to the shape memory alloy member, the voltage and the duty factor "d" of the pulsed supply of electricity being such as to ensure that the relations $\theta$ha greater than $-\theta$ca and "d" less than or equal to $\theta cc/(\theta cc-\theta hb)$, are satisfied; (c) where $\theta$ha is the heating speed of the shape memory alloy member in the region below its As point, $\theta$hb is the heating speed of the shape memory alloy member in the region between its As point and its Af point, $\theta$cc is the cooling speed of the shape memory alloy member in the region above its Ms point, and $\theta$ca is the cooling speed of the shape memory alloy member in the region below its Mf point; and by a device for actuating a member made of shape memory alloy, comprising: (a) a means for stressing the shape memory alloy member so that its Ms point becomes positioned between its As point and its Af point; and (b) a means for applying a pulsed supply of electricity to the shape memory alloy member, the voltage and the duty factor "d" of the pulsed supply of electricity being such as to ensure that the relations $\theta$ha greater than $\theta$ca and "d" less than or equal to $\theta cc/(\theta cc-\theta hb)$ are satisfied; (c) where $\theta$ha is the heating speed of the shape memory alloy member in the region below its As point, $\theta$hb is the heating speed of the shape memory alloy member in the region between its As point and its Af point, $\theta$cc is the cooling speed of the shape memory alloy member in the region above its Ms point, and $\theta$ca is the cooling speed of the shape memory alloy member in the region below its Mf point.

According to this method and device, the shape memory alloy member is heated in an even, smooth, and controlled fashion for its actuation, and there is substantially no risk of overheating any parts of the member during the actuation, because large temperature differentials in the member are not produced at such actuation time. Thus, the service life of the member is kept long, because substantially no damage is engendered to the alloy material of the member, since its temperature is kept stabilized near the tranformation point.

BRIEF DESCRIPTION OF THE DRAWINGS

The present invention will now be shown and described with reference to the preferred embodiments of the device and of the method thereof, and with reference to the illustrative drawings. It should be clearly understood, however, that the description of the embodiment, and the drawings, are all given purely for the purposes of explanation and exemplification only, and none of them are intended to be limitative of the scope of the present invention in any way. In the drawings, like parts and spaces are denoted by like reference symbols in the various figures thereof; in the description, spatial terms are to be everywhere understood in terms of the relevant figure; and wherein.

DESCRIPTION OF THE PREFERRED EMBODIMENT

The present invention will now be described with reference to the preferred embodiments of the device and of the method thereof, and with reference to the appended drawings. First, some theoretical discussion will be made relating to the principle of the present invention.

THEORETICAL DISCUSSION

Figure 1:
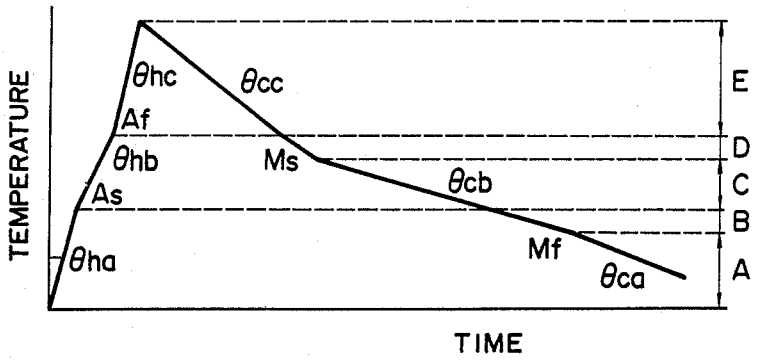
FIG. 1 is a graph showing the temperature of a member made of shape memory alloy plotted against time, during an episode of heating up at a constant heat input rate and subsequent natural cooling down, with the shape memory alloy member being kept under stress.

FIG. 1 is a graph of temperature against time, showing the temperature of a member made of shape memory alloy plotted against time, during a cycle of: first, heating at a constant heat input rate, and, second, natural cooling down (i.e., not forced cooling). This graph relates to the case in which the shape memory alloy member is kept under stress. This graph is somewhat schematic and simplified, so as to show characteristic portions thereof as straight line segments; in fact, as will be shown later with respect to an actual case and with reference to FIG. 5, this simplification does not introduce very much distortion. In this cycle: as the shape memory alloy member is heated up, the As point is the temperature at which the reversion transformation from the martensite phase to the parent phase starts, and the Af point is the temperature at which the reversion transformation ends. As the shape memory alloy member is subsequently cooled down, the Ms point is the temperature at which the martensite phase transformation starts, the Mf point is the temperature at which the martensite phase transformation ends.

If this member made of shape memory alloy were not under stress, then typically the temperature difference between the As point and the Af point would be about 20° to 30° K. and also the temperature difference between the Ms point and the Mf point would be about 20° to 30° K., and the Ms point would be lower than the As point; but under suitable stress the width of each of these temperature intervals is reduced, and also, as shown in FIG. 1, the Ms point is brought to be between the As point and the Af point.

This graph may be broken into the following temperature regions, as shown in FIG. 1: A, below the Mf point; B, between the Mf point and the As point; C, between the As point and the Ms point; D, between the Ms point and the Af point; and E, above the Af point. The shape memory alloy is in the martensite phase in the A region and is in the present phase in the E region, and in the intermediate regions B, C, and D is thought to be a mixture of the parent and the martensite phases.

In these regions in which transformation between the parent and the martensite phases is occurring, because of the latent heat phenomenon, the apparent specific heat of the shape memory alloy is greater, and the rates of heating and cooling are lower. The heating rates are the gradients of the rising portions of the FIG. 1 graph, and will be referred to as follows: below the As point, where the phase transformation from the martensite phase to the parent phase has not yet started, the heating rate is designated as $\theta$ha; between the As point and the Af point, where the phase transformation from the martensite phase to the parent phase is in progress, the heating rate is designated as $\theta$hb; and above the Af point, where the phase transformation from the martensite phase to the parent phase has been completed, the heating rate is designated as $\theta$hc. Similarly, the cooling rates are the gradients of the descending portions of the FIG. 1 graph, and will be referred to as follows: above the Ms point, where the phase transformation from the parent phase to the martensite phase has not yet started, the cooling rate is designated as $\theta$cc; between the Ms point and the Mf point, where the phase transformation from the parent phase to the martensite phase is in progress, the cooling rate is designated as $\theta$cb; and below the Mf point, where the phase transformation from the parent phase to the martensite phase has been completed, the cooling rate is designated as $\theta$ca.

Figure 2:
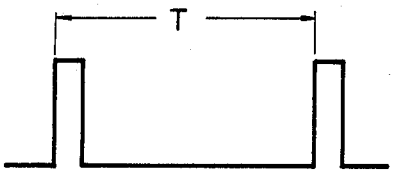
FIG. 2 is a schematic illustration of one duty cycle of a pulsed electrical supply.
Figure 3:
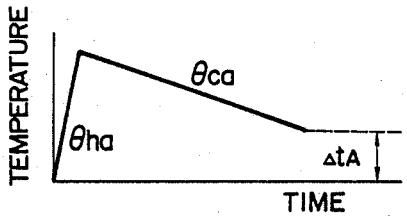
FIGS. 3(A) to 3(E) show the pattern of temperature change against time over one pulse cycle, for each of temperature regions A through E of FIG. 1 respectively.
Figure 3:
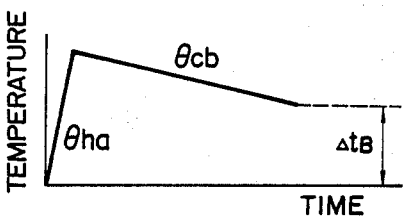
Figure 3:
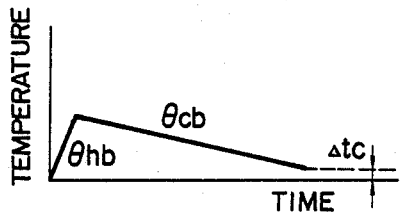
Figure 3:
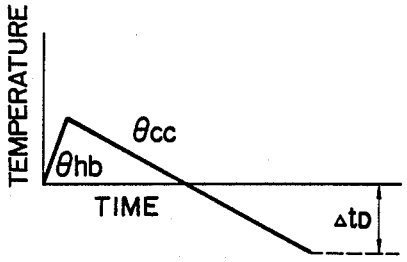
Figure 3:
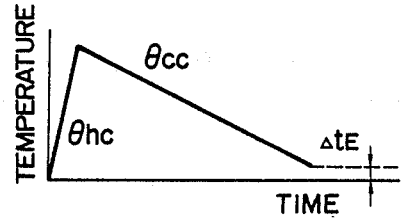

Now, considering one duty cycle of a pulsed electrical supply with a substantially rectangular wave form, as shown in FIG. 2, of period T and of duty factor "d", the infinitesimal temperature changes caused by the Joule effect in each of the regions defined above will be calculated. (i) Region A The heating rate is $\theta$ha and the cooling rate is $\theta$ca, so, if $$\theta_{ha} > -\theta_{ca} \quad \ldots (1)$$

then for one pulse the infinitesimal temperature change is $$\Delta t_A = T\{d\theta_{ha} + (1-d)\theta_{ca}\} \quad \ldots (2)$$

Similarly, for the other regions, the infinitesimal temperature changes are:

(ii) Region B

The heating rate is $\theta$ha and the cooling rate is $\theta$cb, so $$\Delta t_B = T\{d\theta_{ha} + (1-d)\theta_{cb}\} \quad \ldots (3)$$

(iii) Region C

The heating rate is $\theta$hb and the cooling rate is $\theta$cb, so $$\Delta t_C = T\{d\theta_{hb} + (1-d)\theta_{cb}\} \quad \ldots (4)$$

(iv) Region D

The heating rate is $\theta$hb and the cooling rate is $\theta$cc, so $$\Delta t_D = T\{d\theta_{hb} + (1-d)\theta_{cc}\} \quad \ldots (5)$$

(v) Region E

The heating rate is $\theta$ha and the cooling rate is $\theta$cc, so $$\Delta t_E = T\{d\theta_{hc} + (1-d)\theta_{cc}\} \quad \ldots (6)$$

Taking into account latent heat and natural heat radiation, we derive the following relations:

$$\theta_{ha} > \theta_{hc} > \theta_{hb} > 0 \quad \ldots (7)$$

$$\theta_{cc} > \theta_{ca} > \theta_{cb} < 0 \quad \ldots (8)$$

And, with such pulse electric heating, the heating rate is generally faster than the natural cooling rate, so $$\theta_{ha}+\theta_{cc}>0 \quad \ldots (9)$$

and if Mf is near ambient temperature, we experimentally can regard $$\theta_{ca}\approx\theta_{cb} \quad \ldots (10)$$

Therefore, from these relations and from relations (1) through (6), we can order the temperature infinitesimals as:

$$\Delta t_B>\Delta t_A>\Delta t_C>\Delta t_E>_D \quad \ldots (11)$$

Thus in the region D the cooling rate $\theta$cc is considerably large in relation to the heating rate $\theta$hb, so heating is difficult, but by contrast in the region B the cooling rate $\theta$cb is considerably small in relation to the heating rate $\theta$ha, so heating is easy. And in the regions A, C, and E, an intermediate situation occurs.

In FIGS. 3(A) to 3(E), the pattern of temperature change against time over one pulse cycle is illustrated, for each of the temperature regions A through E respectively.

Now, we shall consider heating up the shape memory alloy member gradually from ambient temperature by continuous heating by a successively pulsed electrical current with a substantially rectangular wave form, bearing in mind the above relations.

In the region A near ambient temperature, the temperature rises at speed ΔtA. So, if ΔtA is greater than zero, from equation (11) in the region B inevitably the temperature rise speed ΔtB is higher. So the heating process, once past the region A, soon traverses the region B and reaches the region C, where the heating speed is lower. If the voltage of the pulsed electrical supply is low, or the duty factor "d" thereof is small, there is a risk that thermal equilibrium may be reached somewhere in this region C. But, here, let us assume that the heating process continues through the region C and reaches the region D.

For the temperature rise to continue in the region D, the duty factor "d" of the pulsed electrical supply must satisfy the following relationship, which is obtained from equation (5) under the condition that ΔtD is greater than zero:

$$d>\theta_{cc}/(\theta_{cc}-\theta_{hb}) \quad \ldots (12)$$

But if the duty factor "d" is less than or equal to the above value, i.e.:

$$d\leqq\theta_{cc}/(\theta_{cc}-\theta_{hb}) \quad \ldots (13)$$

then the infinitesimal temperature change for one pulse cycle in this region D is obtained by:

$$\Delta t_D\leqq 0 \quad \ldots (14)$$

Thus, even when warming occurs in the regions A, B, C, and E, there may be no change of temperature or even a falling of temperature in the region D, so that even if the supply of pulsed electrical power is continued, the temperature rise in this region may stop until all of the alloy has transformed from the martensite phase to the parent phase.

In other words, if heating is performed with a pulsed electrical supply of voltage and duty factor "d" which ensure that equations (1) and (13) are satisfied, then the temperature stabilizes in the region C, and even when the shape memory alloy member has a shape which is apt to entail greater temperature differentials than in the case of the conventional actuation method, the temperature differences can be kept relatively small, and the temperature of the member can be stabilized near the phase transformation point.

When heating to satisfy the above conditions is being performed, in each pulse cycle of the electrical power source there will be produced a partial phase transformation and restoration, which will produce an alteration of the shape of the shape memory alloy member, and therefore a sound frequency corresponding to the frequency of the pulsed electrical source will be produced. The sound frequency is in the audible range, i.e., within the range of human hearing. The production of this sound can be used as a check to ensure that the above conditions are being satisfied.

On the other hand, if the duty factor "d" of the pulsed electrical source satisfies the condition (12), then the temperature will rise suddenly as described above, and the shape memory alloy member will be heated far above the phase transformation region, and its operational life may be shortened and heat damage may be caused to it.

DETAILS OF THE PREFERRED EMBODIMENT

Figure 4:
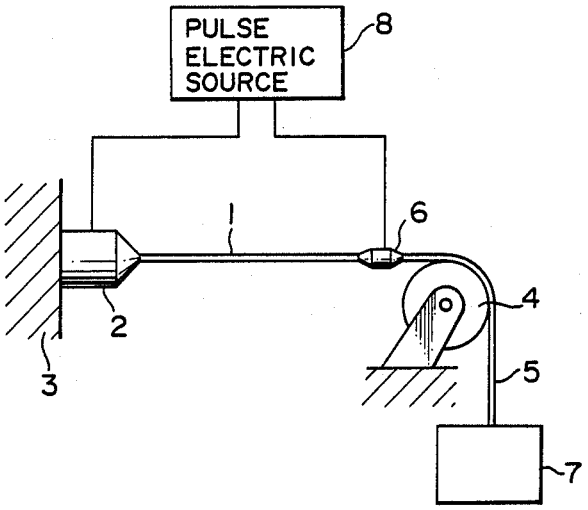
FIG. 4 is a schematic side view showing the concrete details of the preferred embodiment of the device of the present invention.

In FIG. 4, the concrete details of the preferred device embodiment of the present invention are shown in a schematic side view. In this figure, the reference numeral 1 denotes an elongated wire member made of a Ti-Ni shape memory alloy (50% Ti -50% Ni in atomic percent, made by Furukawa Denki Kogyo K. K., Tokyo, Japan), which is a wire of diameter about 0.2 mm and length about 200 mm. One end of this wire 1 is fixed by a chuck 2 to a solid object 3, and the other end of the wire 1 is connected by a clamp member 6 to one end of a stainless steel wire 5. This wire 5 passes over a pulley 4, and to its other end there is fixed a suitable weight 7. This weight 7 puts a tension stress on the shape memory alloy of the wire 1, so as to bring its Ms point between the As point and the Af point as explained previously. In this preferred embodiment, in fact the initial stress on the shape memory alloy 1 produced by the weight 7 is about 75 Mpa (megapascal). And an electric source 8 which supplies a successively pulsed electric current with a substantially rectangular wave form is connected between the two ends of the shape memory alloy wire 1 (via the chuck 2 and the clamp 6), so as to pass the pulsed electric current through the wire 1 to heat it.

Figure 5:
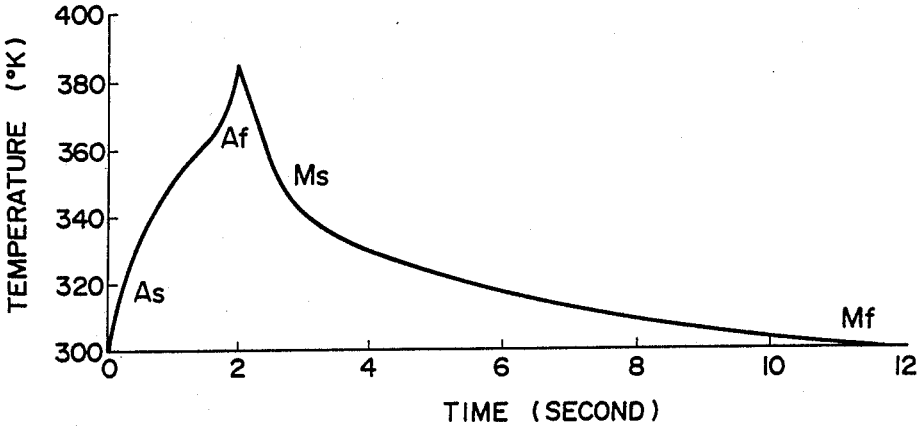
FIG. 5 is a graph of temperature against time, showing the actual temperature in degrees Kelvin of a shape memory alloy member of the preferred device embodiment plotted against time, during a heating and cooling episode, as determined by experimentation.

In order to determine the heating and cooling properties of the shape memory alloy wire member 1 of this preferred embodiment of the device of the present invention, using a 2V DC source (this source was a different source from the above described pulsed electric source 8) the wire 1 was heated to above its Af point, and then the wire member 1 was allowed to cool down naturally. In FIG. 5, which is a graph of temperature against time, the actual temperature of the wire member 1 against time as found in this experiment is shown. As can be seen from this graph, curved portions are evident near the As point, the Af point, the Ms point, and the Mf point, but the other parts of the graph are substantially straight line segments, much like the schematic version of such a heating—cooling graph reproduced in FIG. 1.

If we determine $\theta$hb and $\theta$cc from FIG. 5, we get that, approximately, $\theta$hb is equal to 60° K./sec and $\theta$cc is equal to −25° K./sec. Substituting these values into equation 13, we find that the duty factor "d" should be equal to or less than 0.71.

In fact, it was confirmed that according to the preferred embodiment of the method of the present invention, using the pulsed electric source 8 of FIG. 4 to pass a continuous stream of substantially rectangular pulses through the shape memory alloy wire member 1 so as to heat up the wire member 1, the duty factory of the pulse stream being equal to or less than 0.71 and its voltage being about 2 volts, (and here, again, $\theta$ha was greater than $-\theta$ca), the wire member 1 was uniformly heated up, and the temperature differentials thereover were small, and the temperature of the wire member 1 was stabilized near its transformation region. Accordingly, it was considered that the service life of the wire member 1 would be adequately long, since there was not caused any substantial risk of overheating engendering any damage to the alloy material of the wire member 1.

In the heating method and device described above according to the present invention, the values $\theta$ha, $\theta$hb, $\theta$ca, and $\theta$cc are determined experimentally; but, if the apparent heating rate is the same, it has been found by experience that one can obtain a better effect by using a relatively higher voltage, a relatively lower duty factor, and a shape for the shape memory alloy member which has a higher cooling speed.

Thus, it is seen that according to the present invention there are provided a method and a device which cause the shape memory alloy member to be heated up in an even, smooth, and controlled fashion for its actuation, so that there is substantially no risk of overheating of any parts of the member during the actuation, because large temperature differentials in the member are not produced at such actuation time. Thus, the service life of the member is kept long, because substantially no damage is engendered to the alloy material of the member, since its temperature is kept stabilized near the transformation point.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for actuating a member made of shape memory alloy, which comprises the steps of:

(a) stressing said shape member alloy member so that its Ms point becomes positioned between its As point and its Af point; and (b) applying a successively pulsed supply of electricity with a substantially rectangular wave form to said shape memory alloy member so that the voltage and the duty factor "d" of said pulsed supply of electricity ensure that the relations $\theta$ha greater than $-\theta$ca and "d" less than or equal to $\theta cc/(\theta cc-\theta hb)$ are satisfied, and the frequency of said pulsed supply of electricity is of a frequency which generates sound waves audible to the human ear from said member, where $\theta$ha is the heating speed of said shape memory alloy member in the region below its As point, $\theta$hb is the heating speed of said shape memory alloy member in the region between its As point and its Af point, $\theta$cc is the cooling speed of said shape memory alloy member in the region above its Ms point, and $\theta$ca is the cooling speed of said shape memory alloy member in the region below its Mf point.

2. A method for actuating a member made of shape memory alloy, which comprises the steps of:

(a) stressing said shape memory alloy member so that its Ms point becomes positioned between its As point and its Af point; and (b) applying a successively pulsed supply of electricity with a substantially rectangular wave form to said shape memory alloy member so that the voltage and the duty factor "d" of said pulsed supply of electricity ensure that the relations $\theta$ha greater than $-\theta$ca and "d" less than or equal to $\theta cc/(\theta cc-\theta hb)$ are satisified, where $\theta$ha is the heating speed of said shape memory alloy member in the region below its As point, $\theta$hb is the heating speed of said shape memory alloy member in the region between its As point and its Af point, $\theta$cc is the cooling speed of said shape memory alloy member in the region above its Ms point, and $\theta$ca is the cooling speed of said shape memory alloy member in the region below its Mf point, and the frequency of said pulsed supply of electricity is within a range of frequencies which generate sound waves audible to the human ear from said shape memory alloy member.

3. The method according to claim 1, wherein said duty factor "d" does not exceed 0.71.

4. The method according to claim 2, wherein said duty factor "d" does not exceed 0.71.

* * * * *